US006479944B2

(12) United States Patent
Lee et al.

(10) Patent No.: US 6,479,944 B2
(45) Date of Patent: Nov. 12, 2002

(54) PLASMA DISPLAY PANEL, FABRICATION APPARATUS FOR THE SAME, AND FABRICATION PROCESS THEREOF

(75) Inventors: Mi Kyoung Lee, Kyoungsangbuk-do (KR); Jun Yong Im, Pusan-shi (KR); Won Jeong Lee, Kyonggi-do (KR); Nam Yeol Yang, Kyonggi-do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/910,759

(22) Filed: Jul. 24, 2001

(65) Prior Publication Data

US 2002/0047587 A1 Apr. 25, 2002

(30) Foreign Application Priority Data

Jul. 25, 2000 (KR) ..... 00-42854
Jul. 27, 2000 (KR) ..... 00-43521

(51) Int. Cl.[7] ..... G09G 3/10

(52) U.S. Cl. ..... 315/169.4; 315/169.2; 313/582

(58) Field of Search ..... 315/169.1, 169.2, 315/169.4; 313/582, 583, 584, 585, 586, 484; 445/24, 42, 43

(56) References Cited

U.S. PATENT DOCUMENTS 5,967,872 A * 10/1999 Betsui et al. ..... 445/24
6,160,348 A * 12/2000 Choi ..... 313/584
6,259,212 B1 * 7/2001 Song ..... 315/169.4
6,313,579 B1 * 11/2001 Nakano et al. ..... 313/493
6,400,080 B1 * 6/2002 Tanaka ..... 313/582
6,414,434 B1 * 7/2002 Nakano et al. ..... 313/582
6,428,377 B1 * 8/2002 Choi ..... 445/24

* cited by examiner

*Primary Examiner*—Hoang Nguyen
(74) *Attorney, Agent, or Firm*—Fleshner & Kim, LLP

(57) ABSTRACT

Disclosed are a plasma display panel, apparatus for fabricating the same, and fabrication process thereof enabling to reduce the time for a product process and prevent panel characteristic reduction and panel damage by preventing the generation of impurity gas and achieving the plates-combination at a room temperature. The present invention includes a passivation layer formation means, a substrate transfer means, a cleaning means, a sealing material coating means, and a discharge gas injection/combination means. The present invention is constructed so as to be isolated from the atmosphere. The constructions of the fabrication process and PDP enables the normal temperature combination/attachment so as to increase product efficiency by reducing a process time and improve product quality by preventing the panel characteristic reduction.

42 Claims, 16 Drawing Sheets

PLASMA DISPLAY PANEL, FABRICATION APPARATUS FOR THE SAME, AND FABRICATION PROCESS THEREOF

BACKGROUND OF THE INVENTION

1. Field of the Invention

The present invention relates to a plasma display panel, and more particularly, to a plasma display panel, apparatus for fabricating the same, and fabrication process thereof.

2. Background of the Related Art

This is the age of multimedia, which requires a display enabling to give expression to colors almost the same of the nature as well as fine and large image. For a wide display over 40 inches, it is difficult to introduce the, present CRT(cathode ray tube) and LCD(liquid crystal display) structures. Instead, a plasma display panel attracts public attention in a field of a next generation display.

Such a plasma display panel, as shown in FIG. 1A, is constructed with upper and lower plates 10 and 20 confronting and combined each other. FIG. 1B shows a cross-sectional structure of the plasma display panel in FIG. 1A, in which a face of the lower plate 20 is rotated by 90□ for the convenience of explanation.

The upper plate 10 is constructed with scan electrodes 16 and 16' and sustain electrodes 17 and 17' which are parallel each other, a dielectric layer 11 formed on the upper plate 10 including the scan electrodes 16 and 16' and sustain electrodes 17 and 17', and a passivation layer 12 on the dielectric layer 11. And, the lower plate 20 is constructed with address electrodes 22, a dielectric body layer 21 formed on an a front face of the plate including the address electrodes 22, partition walls 23 formed on the dielectric body layer 21 between the address electrodes 22, and a fluorescence material 24 formed on surfaces of the partition walls and dielectric body layers 21 in the respective discharge cells. And, mixed inert gas such as He, Xe and the like fills up a space between the upper and lower plates 10 and 20 so as to form a discharge area.

Operation of the above-constructed plasma display panel follows.

First, when a driving voltage is applied thereto, a confronting discharge occurs between the address and scan electrodes, whereby portions of electrons discharged from the inert gas in the discharge cells collide with a surface of the passivation layer. Subsequently, secondary electrons are discharged from the surface of the passivation layer by the collision of the electrons. Then, the discharged secondary electrons collide with plasma gas so as to spread the discharge. After the confronting discharge between the address and scan electrodes finishes, wall charges having opposite polarities are generated from the surface of the passivation layer on the address and scan electrodes.

When the driving voltage being applied to the address electrodes is cut off while the discharge voltage having opposite polarities is continuously applied to the scan and sustain electrodes, plane discharge occurs in the discharge area of the surfaces of the dielectric layer and passivation layer by a potential difference between the scan and sustain electrodes. Such confronting and plane discharges make the electrons in the discharge cell collide with the inert gas in the discharge cell. As a result of this, the inert gas in the discharge cell becomes excited and produces an ultraviolet ray having a wave of 147 nm in the discharge cell. Such an ultraviolet ray collides with the fluorescence material surrounding the address electrode, thereby realizing an image.

In order to make the plasma display panel exhibit its performance and elongate its durability, the layers inside the panel should be built solid and no impurity gas except the discharge gas should exist.

A process of fabricating such a plasma display panel may be divided into three parts such as a former process, a latter process, and a module process.

First, the former process is a process of forming various layers on the upper and lower plates 10 and 20. The latter process includes combination of the upper and lower plates 10 and 20, exhaust, discharge gas injection and tip-off, aging, and inspection. In this case, the tip-off is a process comprising the steps of completing the exhaust and discharge gas injection through an exhaust pipe and cutting and sealing the exhaust pipe. And, the aging is a process for removing impurities finally by driving electrodes for a predetermined time by applying a voltage thereto so as to attain a discharge voltage drop.

Finally, the module process is the last process of mounting circuits and assembling parts so as to complete a plasma display panel.

An apparatus for fabricating a plasma display panel and a method of fabricating a plasma display panel according to a related are explained as follows by referring to the attached drawings.

FIG. 2 illustrates a latter process for a plasma display panel and a process condition thereof according to a related art, FIGS. 3A to FIGS. 3C illustrate layouts for explaining a combining process in FIG. 2, FIG. 4 illustrates a cross-sectional view of an exhaust pipe, FIG. 5 illustrates a layout of a combination/exhaust separate type apparatus for a display panel according to a related art, and FIG. 6 illustrates a cart structure in FIG. 5.

The latter process for a plasma display panel(hereinafter abbreviated PDP) according to related art, as shown in FIG. 2, includes combination of the upper and lower plates 10 and 20, exhaust, discharge gas injection and tip-off, aging, and inspection.

First, the upper and lower plates 10 and 20 are transferred to a combination apparatus. And, an edge of the upper plate 10, as shown in FIG. 3A, is coated with a sealing material 31, i.e. frit, to the uniform thickness using a dispenser. In this case, the frit consists of glass, $SiO_2$, and an additive for improving adhesiveness.

And, they are dried at about 120° and thermally treated at a high temperature over 400° C. in order to remove impurities remaining in the frit.

Then, the thermally-treated upper and lower plates are transferred to a combination apparatus. In this case, the upper plate 10 is transferred to the combination apparatus by being exposed to the atmosphere.

AS shown in FIG. 3B, the upper and lower plates 10 and 20 are aligned to each other in the combination apparatus. And, the upper and lower plates 10 and 20 are fixed by combination clamps 32. Then, the upper and lower plates 10 and 20, as shown in FIG. 3C, are combined with each other by melting the frit.

When carrying out the combination process, an exhaust pipe 40 consisting of a long-straw type glass is attached to an exhaust hole 42 of the lower plate 20 using a frit ring.

Then, a panel of which combination is finished is transferred to an exhaust and gas injection apparatus.

The exhaust and gas injection apparatus carries out an exhaust process exhausting impurities sticking to a layer and impurity gas generated from the layer outside using the exhaust pipe 40 formed in the combination process.

Then, discharge gas is injected through the exhaust pipe 40. And, a tip of the exhaust pipe 40 is tipped off by applying a heat thereto, thereby preventing the leakage of the injected discharge gas.

Subsequently, the process is completed by inspecting a state of the panel after the aging.

Thus, a separate type fabrication apparatus, which carries out the combination and the exhaust and gas injection separately in exhaust pipe type fabrication apparatuses, is divided into the combination apparatus and the exhaust and gas injection apparatus. The exhaust and gas injection apparatus, as shown in FIG. 5, includes a hot-wind heating furnace 51 to establish an exhaust and discharge gas injection condition and a cart 52 loading a panel and unloading the panel on which the exhaust and discharge gas injection has been carried out in the hot-wind heating furnace 51.

The cart 52, as shown in FIG. 6, is constructed complicatedly with a vacuum pump 61 to make vacuum inside the panel, a vacuum pipe system including an exhaust manifold 62, valves and pipes, a bombe 65 for discharge gas injection, a gas injection pipe system including a gas injection manifold 63, valves and pipes, and a tip-off unit 64 to tip off the exhaust pipe 40.

Unfortunately, the above-constructed pipe type PDP fabrication apparatus and fabrication process thereof contains the following problems.

First, impurity gas in a gap between the upper and low plates, which are combined with each other and leave an interval of several microns, of the panel over 40 inches wide has to be sucked through a long and narrow exhaust pipe, which takes at least several hours in a high vacuum state of $10^{-7}$ Torr. Thus, the bottleneck of a product process is resulted. Therefore, the number of apparatuses increases for mass production, thereby failing to avoid increasing a space for the apparatuses.

Second, an intense heat is applied thereto in a high vacuum state, which carries a massive load on the panel. And, the panel is formed of glass vulnerable to heat deviation and pulling intensity, thereby failing to avoid panel damage or panel characteristic degradation.

Third, the exhaust pipe also made of glass may be broken by an impact on transference or temperature variance on exhaust, whereby automation of the panel fabrication is hardly achieved.

Fourth, the plastic process is carried out to remove the impurities of the frit. Yet, energy loss is increased due to heating and cooling of the plastic process. And, a great deal of impurities is generated again from the frit due to the high heat applied thereto during the combination process. Thus, the exhaust time is increased and the frit fragile to external impact may cause the panel breakage due to the external impact.

Fifth, the passivation layer of the upper plate is formed to play an important role for the prevention of the damage on the electrodes during discharge. But, the passivation layer exposed to the atmosphere is transferred to the combination process and then the exhaust and discharge gas injection process is carried out. 'MgO' widely used as a material for the passivation layer is easy to be contaminated by being combined with the atmospheric components such as H2O and the like. Therefore, degradation of product performance and reduction of product durability are brought about.

Sixth, an intense heat is applied thereto in the high vacuum state on combining the upper and lower plates so as to carry a massive load on the panel formed of glass vulnerable to heat deviation and pulling intensity, thereby failing to avoid panel damage or panel characteristic degradation.

Seventh, the plastic process is carried out to remove the impurities of the frit. Yet, energy loss is increased due to heating and cooling of the plastic process. And, a great deal of impurities is generated again from the frit due to the high heat applied thereto during the combination process. Thus, the exhaust time is increased and the frit fragile to external impact may cause the panel breakage due to the external impact.

Besides, in order to overcome the above problems, proposed are a tip-less process using no exhaust pipe and a semi-tip-less process injecting discharge gas through an additional hole instead of filling in the chamber with discharge gas. However, theses processes fail to prevent the generation of impurity gas penetrating into the panel, thereby causing the discharge gas contamination which is the fatal defect of the no-pipe process. Thus, both of the tip-less and semi-tip-less fail to be applied to the product production practically.

SUMMARY OF THE INVENTION

Accordingly, the present invention is directed to a plasma display panel, apparatus for fabricating the same, and fabrication process thereof that substantially obviates one or more problems due to limitations and disadvantages of the related art.

An object of the present invention is to provide a plasma display panel, apparatus for fabricating the same, and fabrication process thereof enables to reduce the time for a product process and prevent panel characteristic reduction and panel damage by preventing the generation of impurity gas and achieving the plates-combination at a room temperature.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, an apparatus for fabricating a plasma display panel according to the present invention includes a passivation layer formation means for forming a MgO passivation layer on a first substrate, a substrate transfer means for receiving the first substrate from the passivation layer formation means, the substrate transfer means transferring the received first substrate and a second substrate inserted therein to a next fabrication stage, a cleaning means for removing impurities existing on the first or second substrate transferred through the substrate transfer means, a sealing material coating means for coating a sealing material on the first substrate transferred through the cleaning means, and a discharge gas injection/combination means for injecting discharge gas inside, the discharge gas injection/combination means for aligning precisely the first substrate transferred through the sealing material coating means and the second substrate with each other using an alignment robot, the discharge gas injection/combination means for combining the first and second substrates with each other.

In another aspect of the present invention, a process for fabricating a plasma display panel using an ultraviolet ray producing means according to the present invention includes the steps of coating a predetermined area of a first substrate with a sealing material having elasticity and hardened by ultraviolet rays, aligning a second substrate with the first substrate, and combining/attaching the first and second substrates with/to each other by applying the ultraviolet rays to the sealing material with the ultraviolet ray producing means.

In a further aspect of the present invention, a plasma display panel includes a first substrate, a sealing material coated on a predetermined area of an effective image circumference of the first substrate, the sealing material having predetermined width and height, a second substrate aligned over the first substrate, the second substrate adhering closely to a surface of the sealing material, and a plurality of pressurization means for applying a predetermined pressure so as to maintain a combination/attachment state between the first and second substrates, the pressurization means mounted along the circumference of the first substrate and a circumference of the second substrate with a predetermined interval therebetween.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1A:
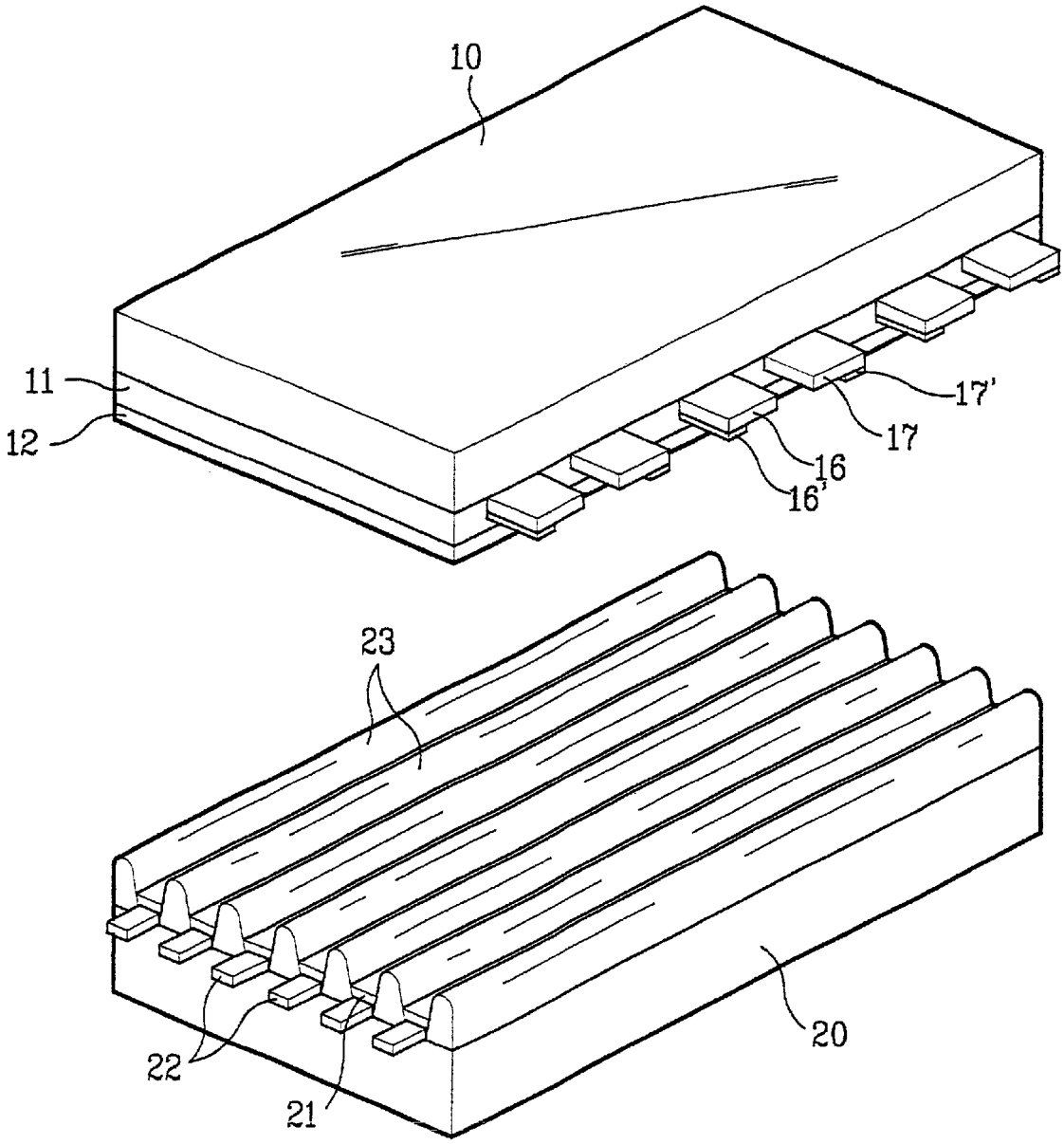
FIG.1A Related Art
FIG. 1A and FIG. 1B illustrate bird's-eye and cross-sectional views of a general plasma display, respectively
Figure 1B:
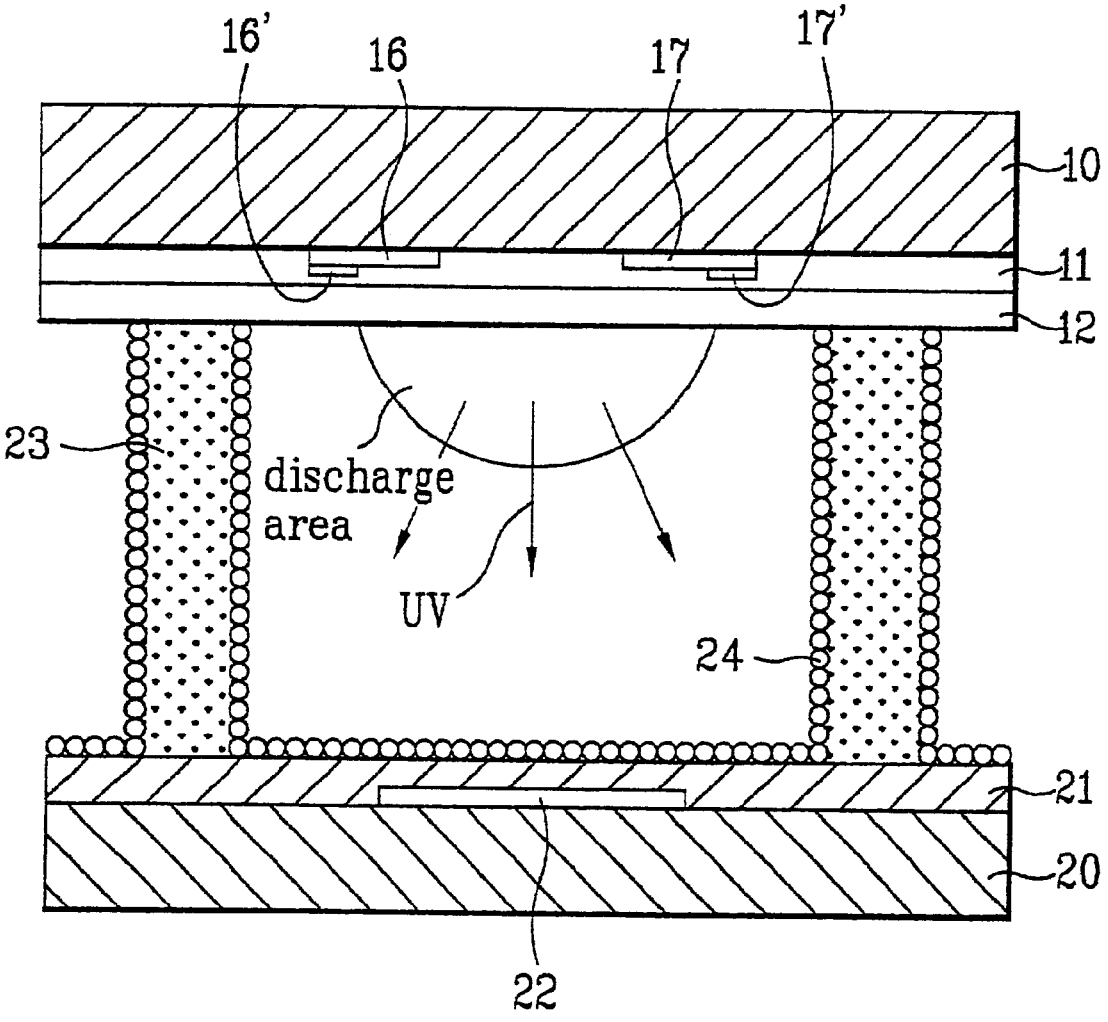
FIG.1B Related Art
Figure 2:
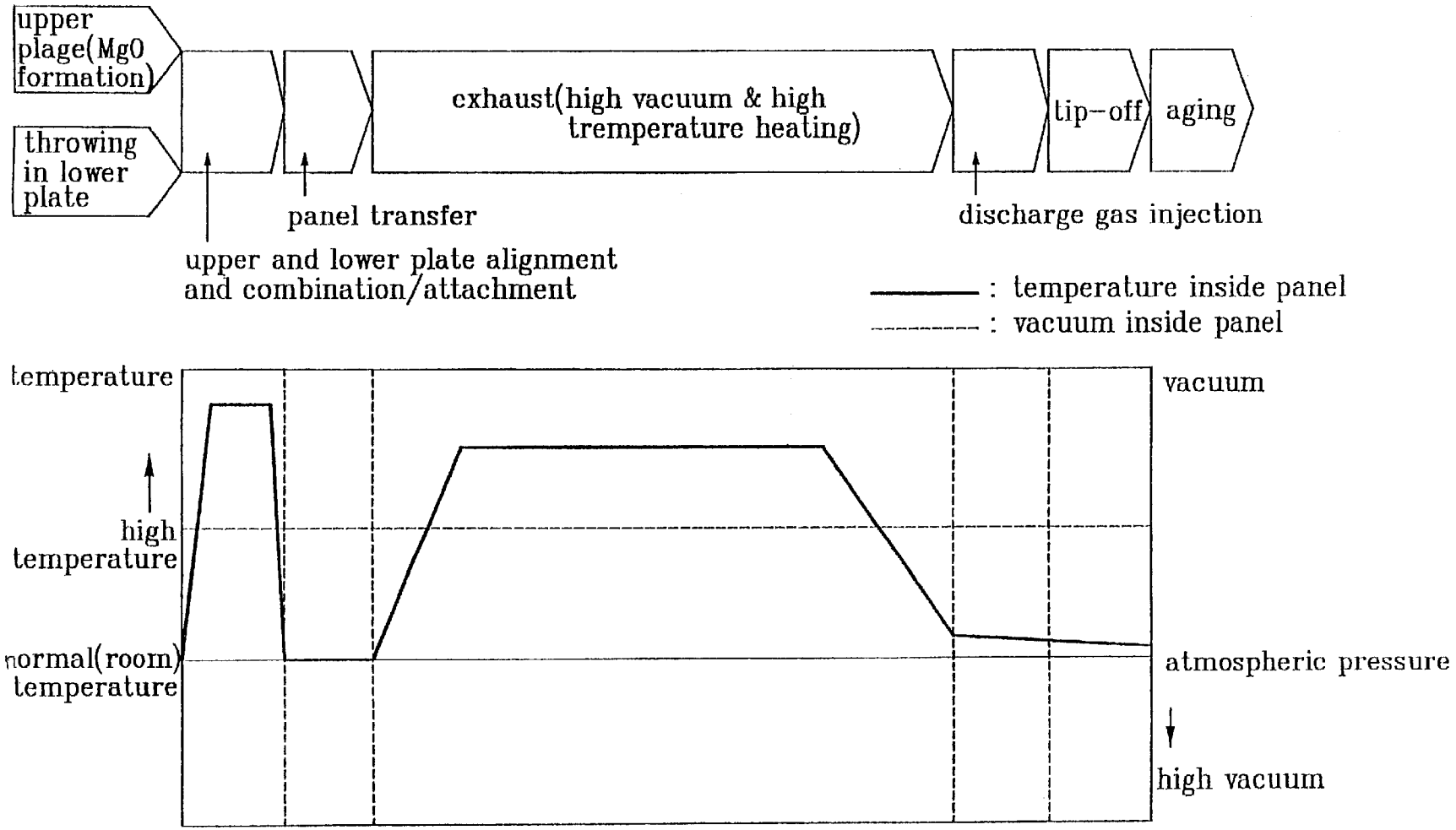
FIG.2 Related Art
FIG. 2 illustrates a latter process for a plasma display panel and a process condition thereof according to a related art.
Figure 3A:
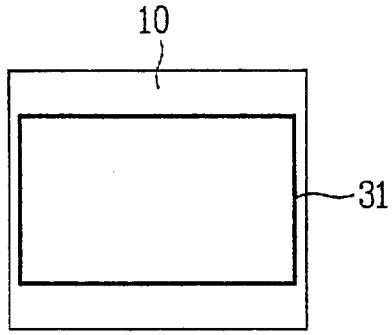
FIG.3A Related Art
FIGS. 3A to FIGS. 3C illustrate layouts for explaining a combining process in FIG. 2.
Figure 3B:
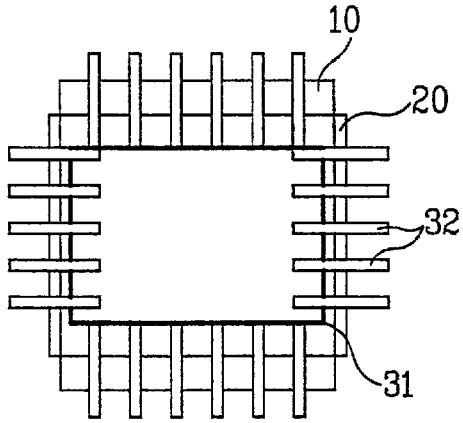
FIG.3B Related Art
Figure 3C:
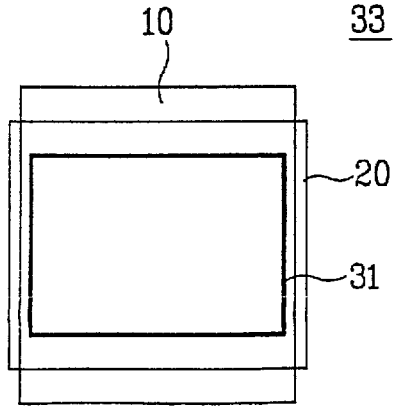
FIG.3C Related Art
Figure 4:
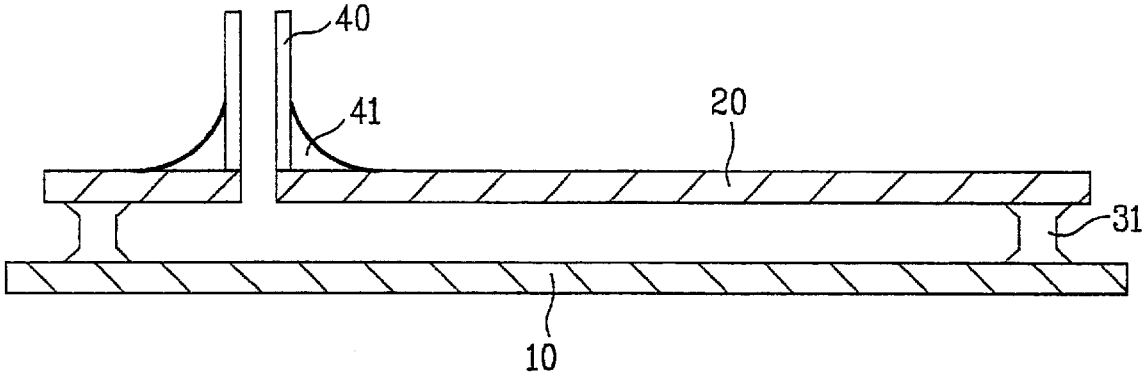
FIG. 4 Related Art
FIG. 4 illustrates a cross-sectional view of an exhaust pipe.
Figure 5:
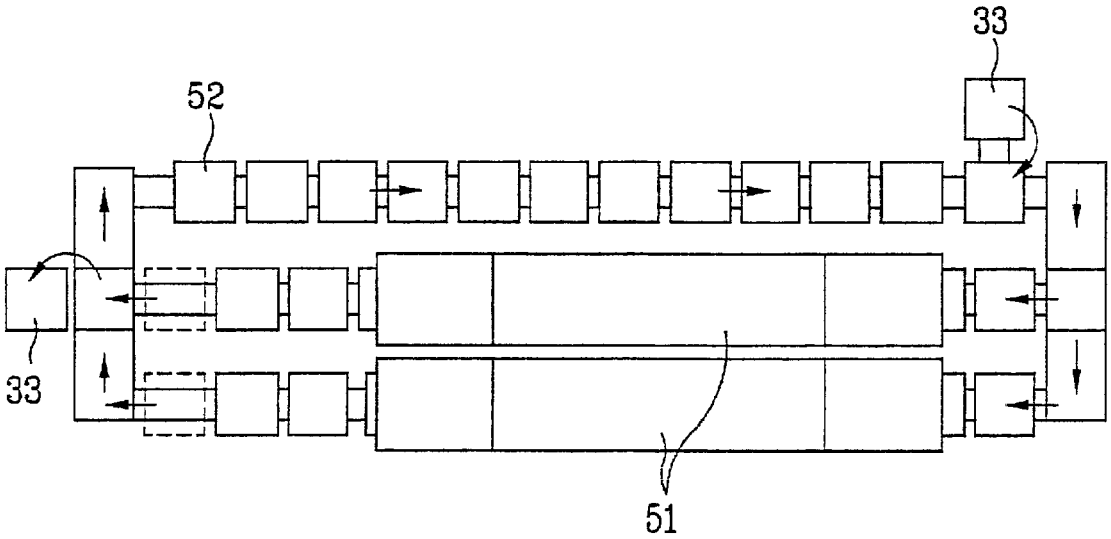
FIG. 5 Related Art
FIG. 5 illustrates a layout of a combination/exhaust separate type apparatus for a display panel according to a related art.
Figure 6:
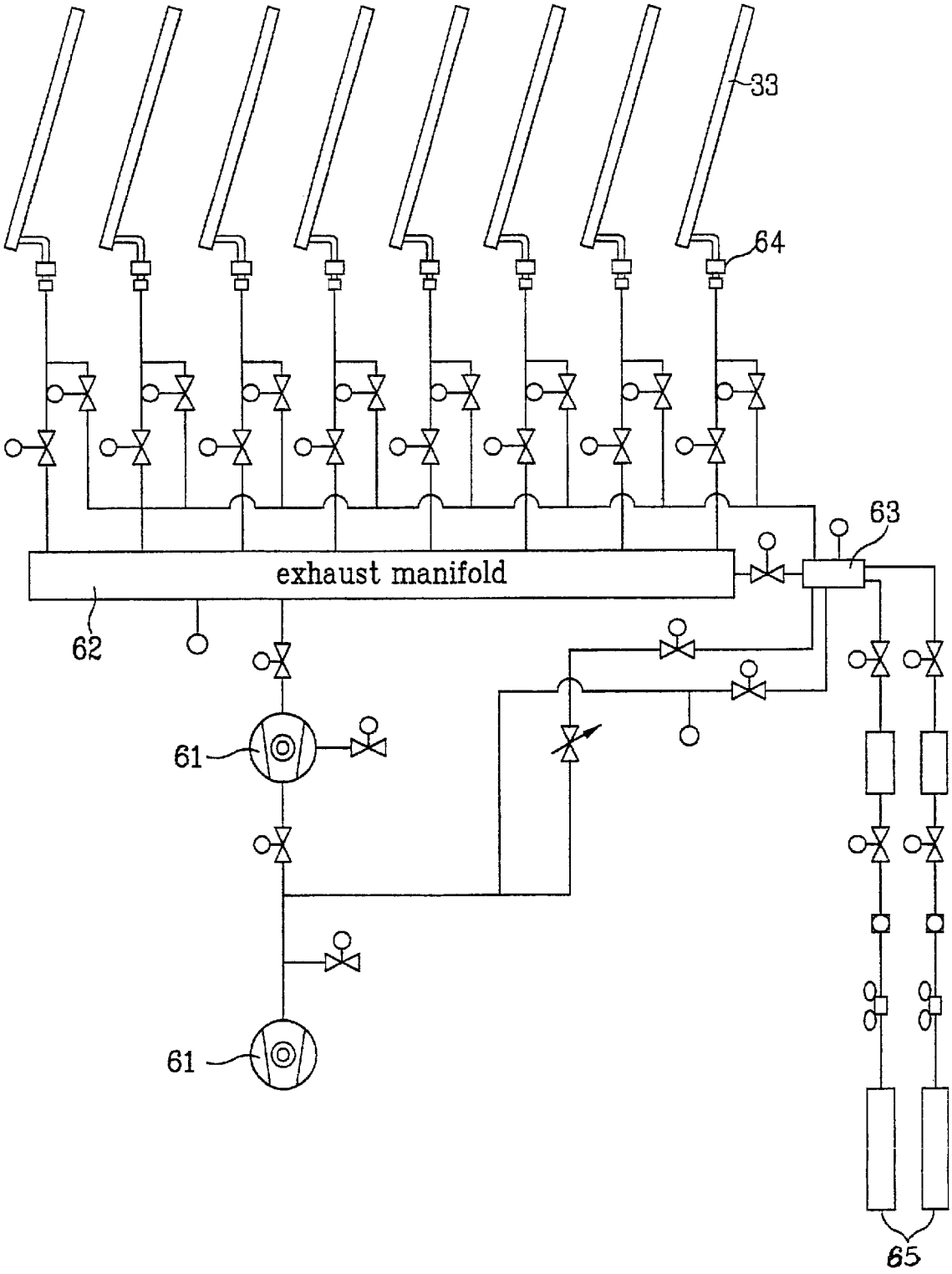
FIG.6 Related Art
FIG. 6 illustrates a cart structure in FIG. 5.
Figure 7:
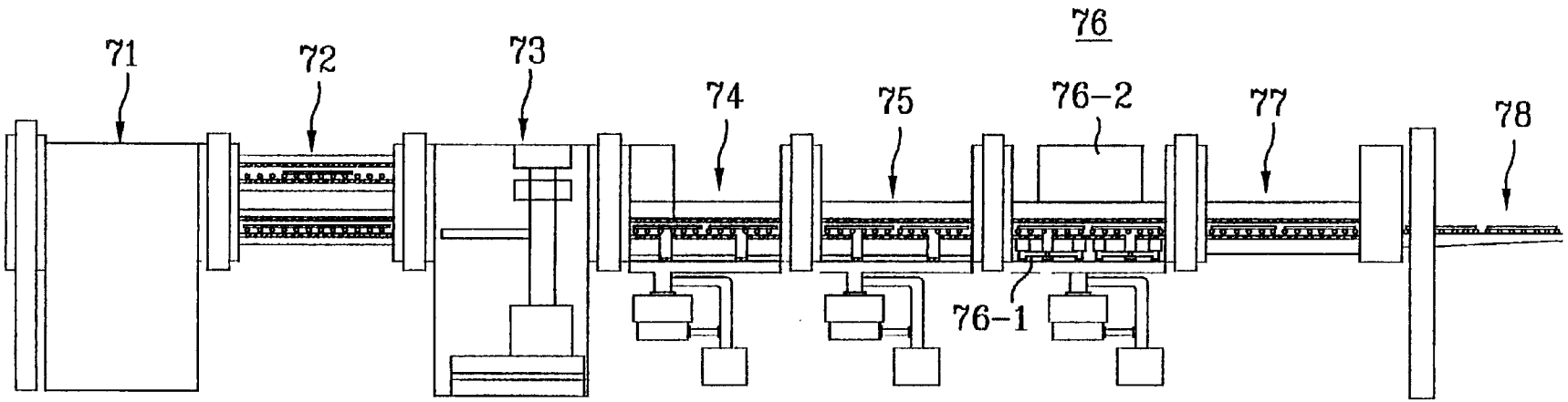
FIG. 7 illustrates a construction of a fabrication apparatus for PDP according to the present invention.

FIG. 7 illustrates a construction of a PDP fabrication apparatus according to the present invention.

A PDP fabrication apparatus according to the present invention, as shown in FIG. 7, is constructed with an upper plate passivation layer formation chamber 71 to form a MgO passivation layer on an upper plate 100, a substrate transfer chamber 72 constructed with two stories and transferring the upper plate 100 received from the upper plate passivation layer formation chamber 71 and a lower plate 120 inserted therein without being exposed to the atmosphere to a next fabrication apparatus, a prealignment chamber 73 carrying out temporary alignment to combine the upper and lower plates with each other transferred through the substrate transfer chamber 72 using a first alignment robot, a cleaning chamber 74 removing impurities existing in the upper and lower plates 100 and 120 aligned by the pre-alignment chamber 73 and carrying out vacuum exhaust, a sealing material coating chamber 75 coating the upper plate 100 with a sealing material, a discharge gas injection/combination and discharge gas refinement chamber 76 injecting discharge gas in a chamber, carrying out precision alignment on the upper and lower plates 100 and 120 using a second alignment robot, combining the upper and lower plates 100 and 120, recovering the discharge gas inside after finishing the combination and refining the recovered discharge gas, and a panel unloading chamber 77 unloading a finished panel and transferring the unloaded panel to a panel holder 78.

In this case, the present invention is an atmosphere-proof apparatus built in one body so as have the upper plate having the passivation layer not to be exposed to the atmosphere until the combination of the upper plate 100 is finished.

The first and second alignment robots introduce a vision system used for a part handling industrial robot and the like which carry out image recognition and measurement/control on the upper and lower plates of the panel and align an object to a corresponding position in accordance with the result of the measurement.

The discharge has injection/combination and discharge gas refinement chamber 76 is constructed with a discharge gas injection/combination unit 76-1 discharge gas is injected therein, aligning the upper and lower plates 100 and 120 using the second alignment robot, and combining the upper and lower plates 100 and 120 with each other and a discharge gas refinement unit 76-2 recovering the remaining discharge gas after the completion of the combination and extracting and storing the discharge gas having a wanted quality by removing impurities and refining the recovered discharge gas.

A material enables to be used for the combination at a room temperature as the sealing material for combining the upper and lower plates 100 and 120 such as a material hardened by ultraviolet rays. Therefore, the present invention may have the discharge gas injection/combination unit 76-1 equipped with an ultraviolet ray producing means.

The above-constructed PDP fabrication process according to the present invention is described as follows be referring to FIG. 8.

Figure 8:
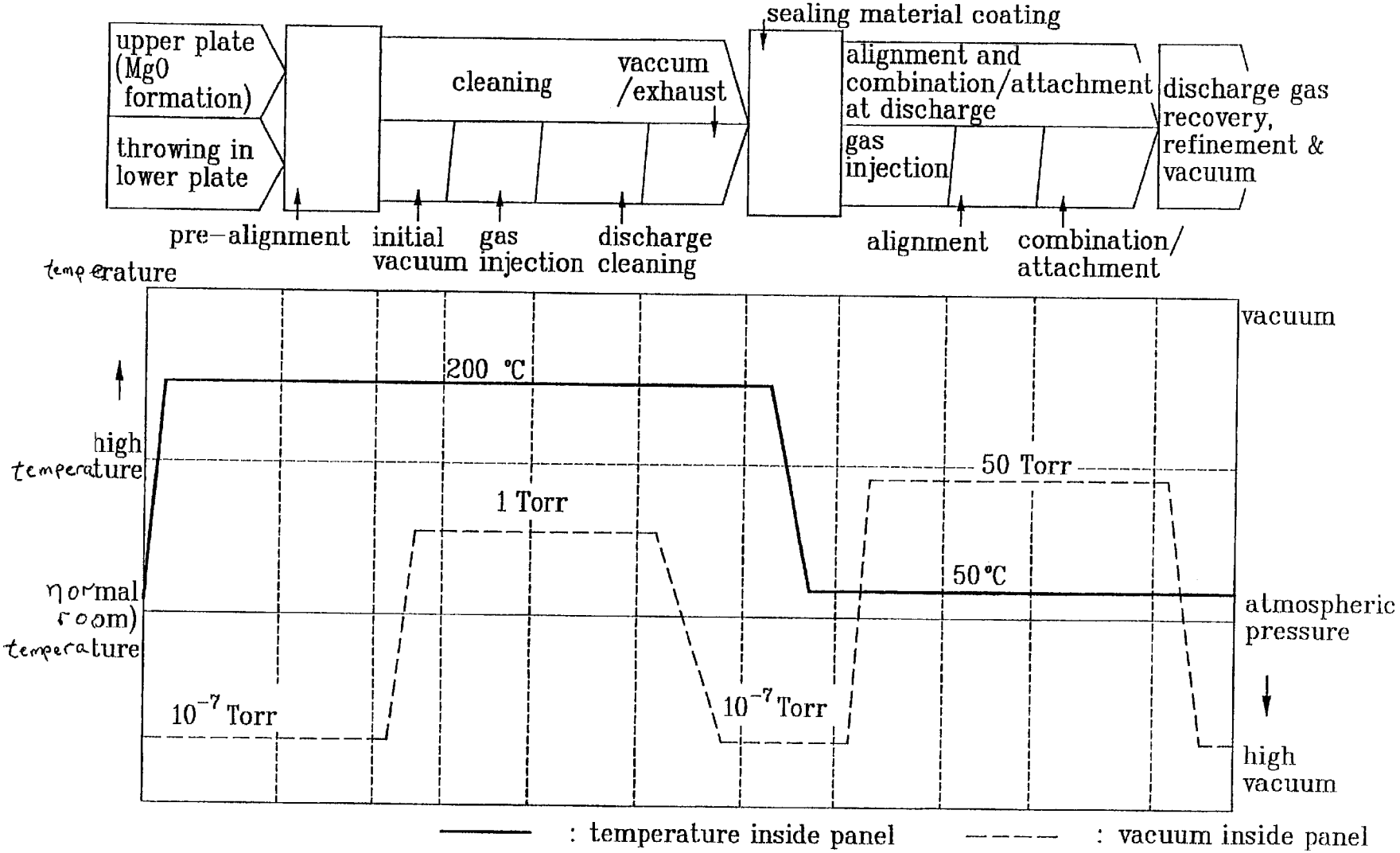
FIG. 8 illustrates a PDP fabrication process and process conditions thereof according to the present invention.

Referring to FIG. 8, a MgO passivation layer is formed on the upper plate 100 at a temperature of 200° C. at $10^{-7}$ Torr in the upper plate passivation layer formation chamber 71, which is then transferred to the substrate transfer chamber 72 without being exposed to the atmosphere.

The substrate transfer chamber 72 receives the upper plate 100 having the passivation layer at the same state, i.e. at 200° C. and $10^{-7}$ Torr, of the upper plate passivation layer formation chamber 71. And, the lower plate 120 is inserted into the substrate transfer chamber 72. Then, the upper and lower plates 100 and 120 are transferred to the pre-alignment chamber 73 by the substrate transfer chamber 72 without being exposed to the atmosphere.

The pre-alignment chamber 73 carries out temporary alignment for the combination between the upper and lower plates 100 and 120 transferred from the substrate transfer chamber 72 using the first alignment robot having the vision system under the same condition as the substrate transfer chamber 72.

Subsequently, the temporarily-aligned upper and lower plates 100 and 120 are sent to the cleaning chamber 74 without being exposed to the atmosphere, and then undergo a cleaning process comprising four steps at a predetermined temperature and pressure condition(200° C. and a variable inner pressure) in the cleaning chamber 74.

First, impurity gas is primarily removed by an initial vacuum state, $10^{-7}$ Torr, in the cleaning chamber 74.

Subsequently, the cleaned panel is coated with the sealing material enabling a room temperature combination/attachment in he sealing material coating chamber 75. And, the combination/attachment between the upper and lower plates 100 and 120 are carried out at a room temperature in the discharge gas injection/combination unit 76-1, in which discharge gas is injected, of the discharge gas injection/combination and discharge gas refinement chamber 76.

In this case, the sealing material for combination/attachment uses a material enabling the hardening and combination not by heat but by ultraviolet rays without producing impurities. Thus, the upper and lower plates 100 and 120 are combined/attached to each other by irradiating ultraviolet rays to the sealing material using the UV producing means at a room temperature.

After the combination between the upper and lower plates 100 and 120 has been completed, the panel is transferred to the panel unloading chamber 77.

Then, the panel unloading chamber 77 transfers and mounts the panel to and on the panel holder 78. In this case, the panel transfer to the panel holder 78 is carried out through a roller hearth.

On the other hand, after the panel, which has undergone the discharge gas injection and combination in the discharge gas injection/combination unit 76-1 of the discharge gas injection/combination and discharge gas refinement chamber 76, is transferred to the panel unloading chamber 77, the discharge gas refinement unit 76-2 recovers the discharge gas remaining in the discharge gas injection/combination unit 76-1, removes the impurities therein, and refines the recovered discharge gas so as to extract and store the discharge gas having a predetermined quality in a storage tank. Thus, the discharge gas is recycled for a next discharge gas injection.

Reference will now be made in detail to first to fifth embodiments of sealing material coating and combination processes in the above-described PDP fabrication process according to the present invention, examples of which are illustrated in the accompanying drawings.

[First Embodiment]

Figure 9A:
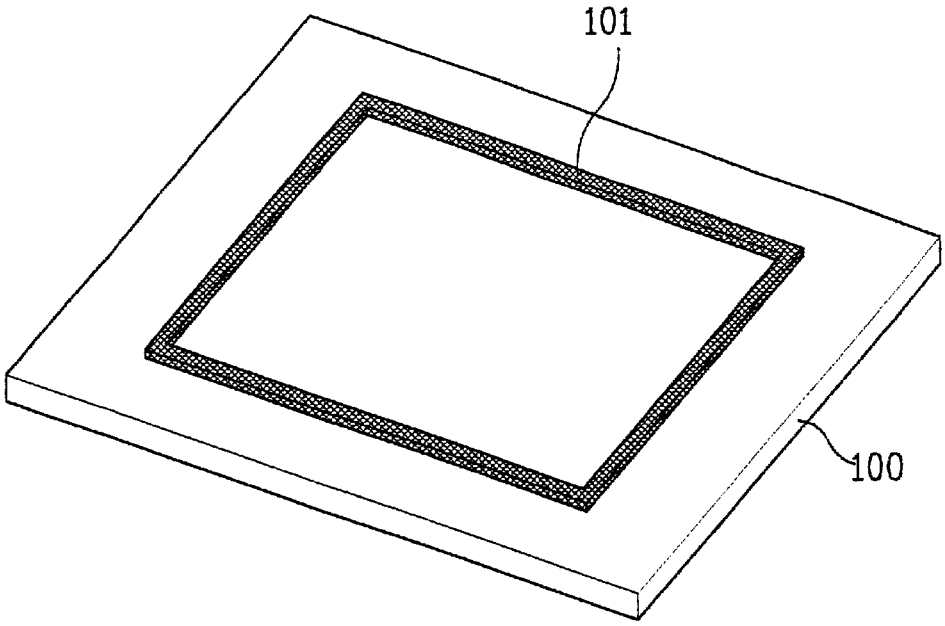
FIG. 9A and FIG. 9B illustrate a PDP combination process according to a first embodiment of the present invention.

In a first embodiment of the PDP combination process according to the present invention, as shown in FIG. 9A, an elastomer based sealing material 101 is coated on an effective image area circumference of the upper plate 100 to surround.

In this case, the elastomer based sealing material 101 is a rubber different from the conventional sealing material such as the frit has a characteristic of being hardened by UV rays at a room temperature without being heated, and specifically, discharges no impurity gas in accordance with heating or pressurization, and has its own elasticity enough to reduce the external impact applied to the upper and lower plates 100 and 120.

Figure 9B:
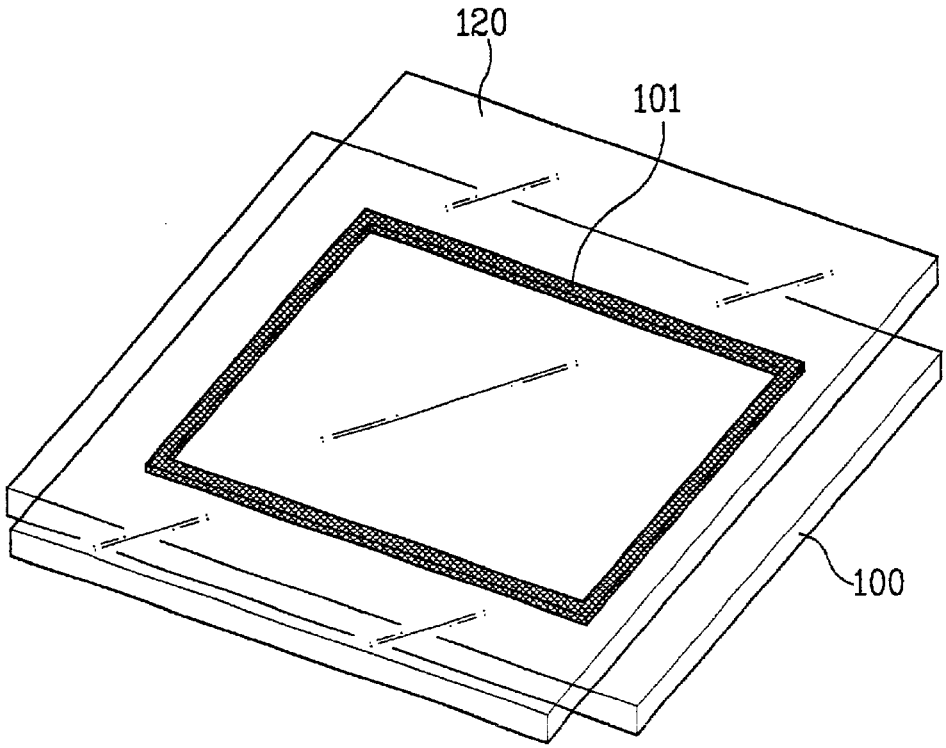

Referring to FIG. 9B, after the lower plate 120 is aligned to the upper plate 100, the sealing material 101 is hardened by being irradiated with UV rays using a UV producing apparatus(not shown in the drawing) so as to combine/attach the upper and lower plates 100 and 120 with/to each other.

[Second Embodiment]

Figure 10A:
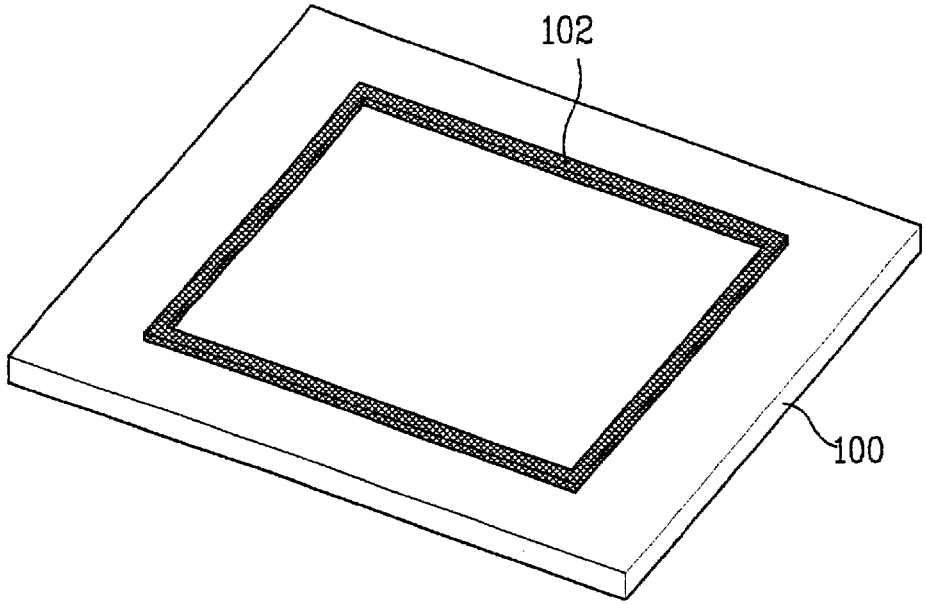
FIG. 10A and FIG. 10B illustrate a PDP combination process according to a second embodiment of the present invention.

In a second embodiment of the PDP combination process according to the present invention, as shown in FIG. 10A, an elastomer based sealing material 102 is coated on an effective image area circumference of the upper plate 100 to surround.

In this case, the elastomer based sealing material 102, despite having no adhesiveness, is a rubber different from the conventional sealing material such as the frit, produces no impurity gas in accordance with heating or pressurization, and has its own elasticity enough to reduce the external impact.

Figure 10B:
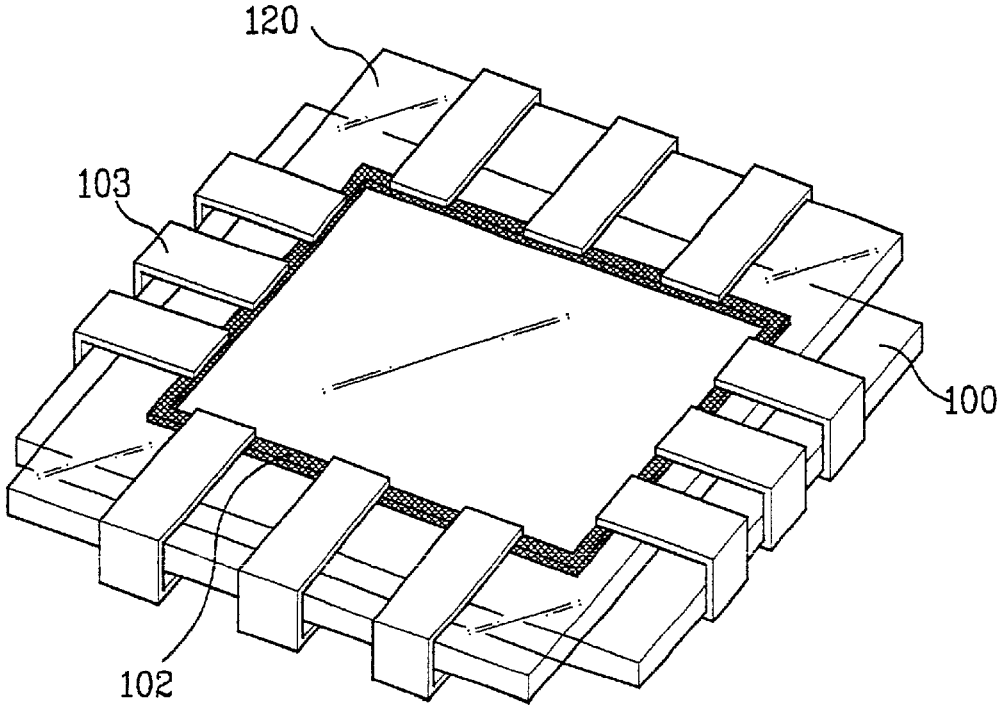

Referring to FIG. 10B, after the lower plate 120 is aligned to the upper plate 100, the upper and lower plates 100 and 120 are combined and attached each other using at least a pressurizing means such as a clip 103.

In this case, the clip 103 having a restoring force toward a direction of fastening the upper and lower plates 100 and 102 applies a predetermined pressure to the upper and lower plates 100 and 120 so as to seal up the upper and lower plates 100 and 102.

Moreover, the sealing material 102 having elasticity buffs the force of the clip 103 fastening the upper and lower plates 100 and 120 as well as the external impact.

[Third Embodiment]

Figure 11A:
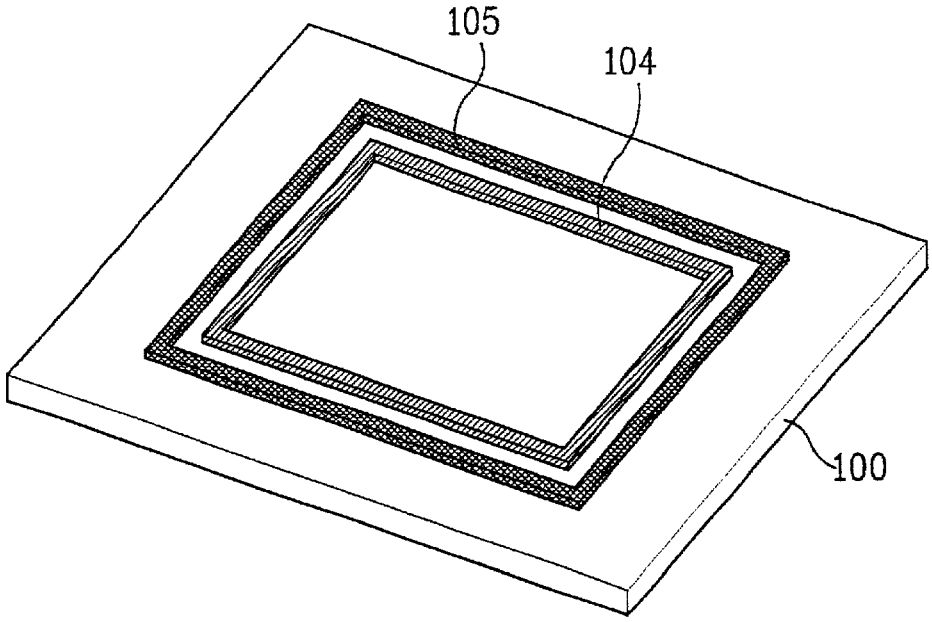
FIG. 11A and FIG. 11B illustrate a PDP combination process according to a third embodiment of the present invention.

In a third embodiment of the PDP combination process according to the present invention, as shown in FIG. 11A, an elastomer based sealing material 104 is coated on a circumference of an effective image area of the upper plate 100 to surround.

In this case, the elastomer based sealing material 104, despite having no adhesiveness, is a rubber different from the conventional sealing material such as the frit, produces no impurity gas in accordance with heating or pressurization, and has its own elasticity enough to reduce the external impact.

And, a circumference of the sealing material 104 is coated with an adhesive agent 105 tending to coagulate at a room temperature.

In this case, the adhesive agent 105 is a material enabling to coagulate immediately at a room temperature, pressurize the sealing material 104 inside, and endure compression/pulling forces.

Figure 11B:
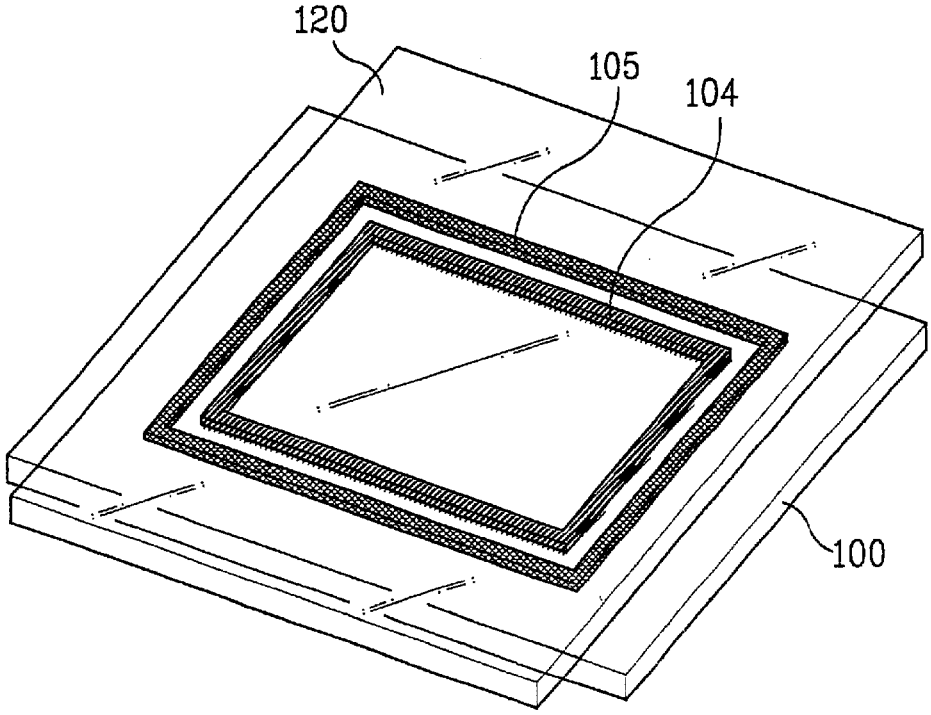

Referring to FIG. 11B, after the upper and lower plates 100 and 120 are aligned to each other precisely, the upper and lower plates 100 and 120 maintains to combined each other by applying a predetermined pressure thereto.

Then, the compressed state of the upper and lower plates 100 and 120 are maintained as the adhesive agent 105 coagulates.

[Fourth Embodiment]

Figure 12A:
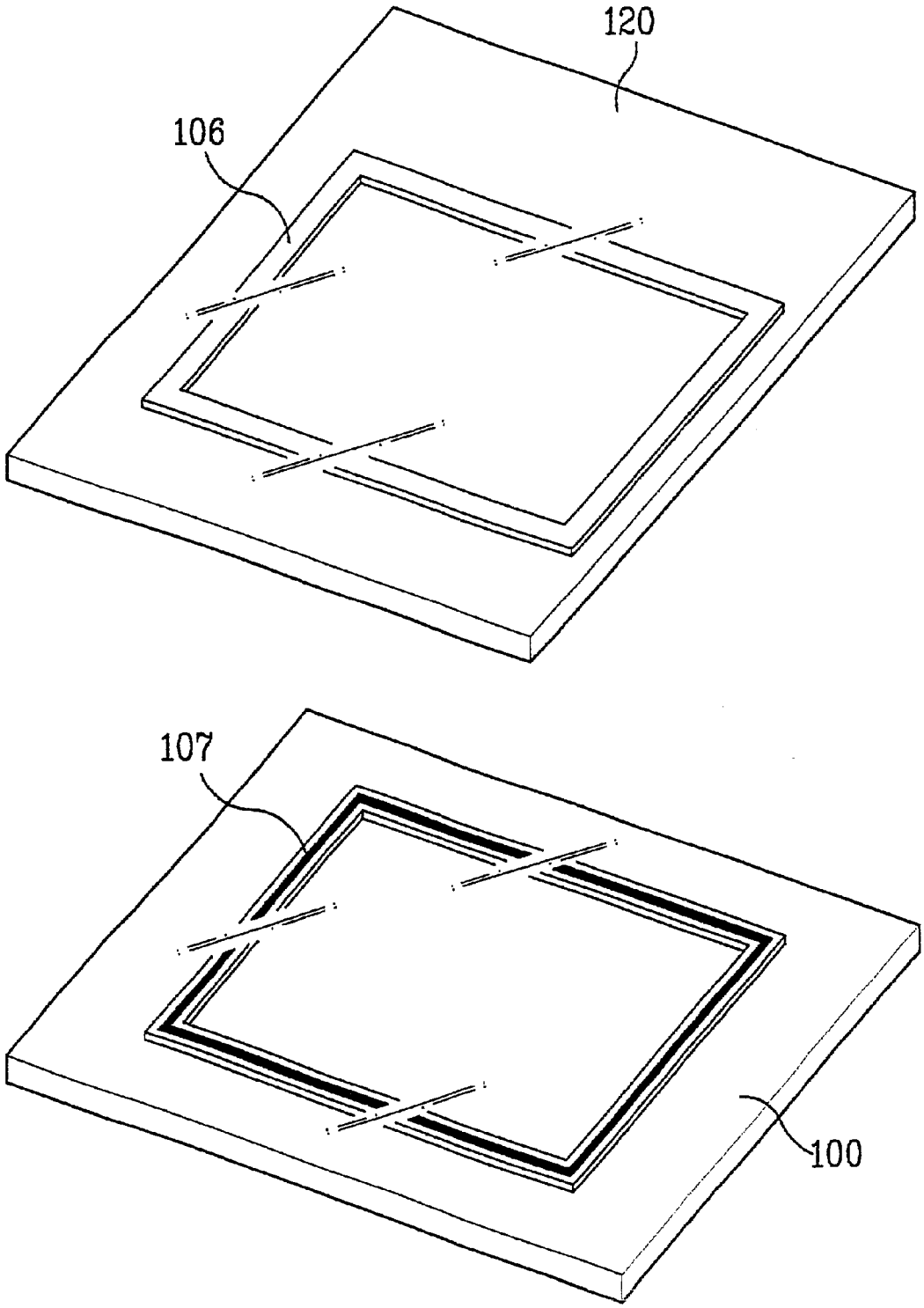
FIG. 12A to FIG. 12D illustrate a PDP combination process according to a fourth embodiment of the present invention.

In a fourth embodiment of the PDP combination process according to the present invention, as shown in FIG. 12A, an elastomer based sealing material 106 is coated on a circumference of an effective image area of the upper plate 100 to surround and the sealing material 106 is also coated on a predetermined area of the lower plate 120 corresponding to the sealing material coated area of the upper plate 100. And, an adhesive agent 107 is coated on the sealing material 106 coated on the upper plate 100.

In this case, the elastomer based sealing material 106, despite having no adhesiveness, is a rubber different from the conventional sealing material such as the frit, produces no impurity gas in accordance with heating or pressurization, and has its own elasticity enough to endure the external impact. And, the adhesive agent 107 is a material enabling to coagulate immediately at a room temperature, pressurize the sealing material 106 outside, and endure compression/pulling forces.

Figure 12B:
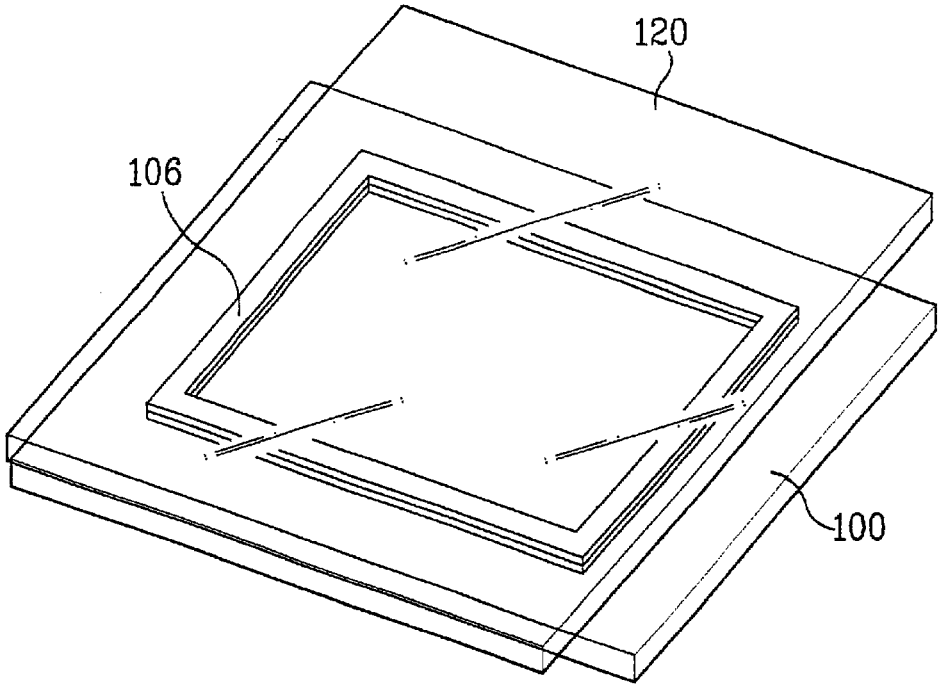

Referring to FIG. 12B, after the lower plate 120 is aligned to the upper plate 100, the upper and lower plates 100 and 120 are combined and attached each other by applying a predetermined pressure thereto.

Figure 12C:
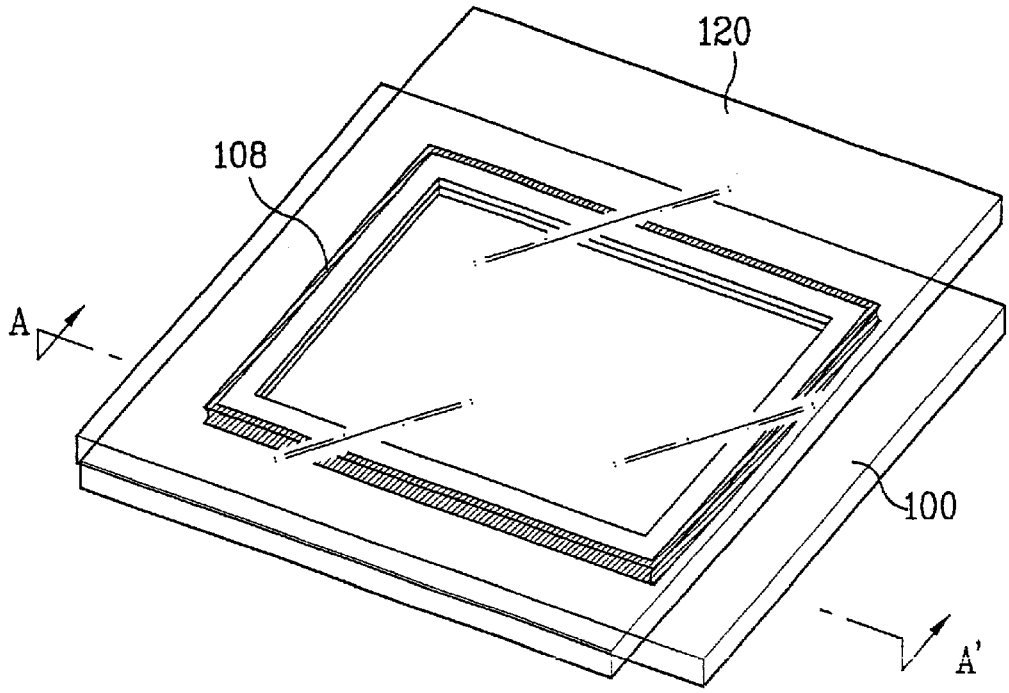

Referring to FIG. 12C, a circumference of the sealing material 106 of the combined/attached upper and lower plates 100 and 120 is coated with a silicon or polymer based second sealing material 108 so as to carry out a second sealing process.

Figure 12D:
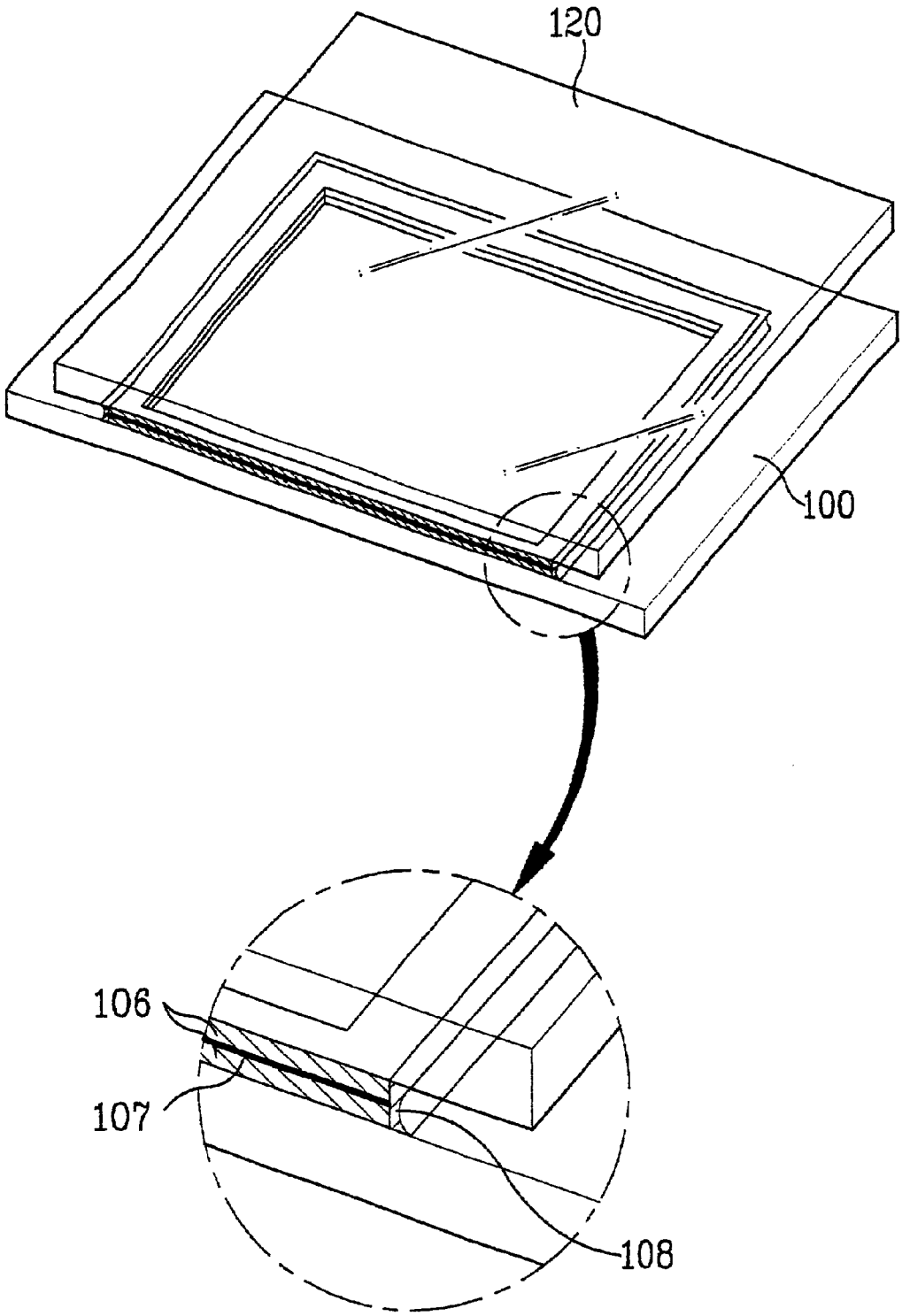

FIG. 12D shows a cross-sectional view of the PDP bisected along a cutting line A—A' in FIG. 12C so as to describe the structure according to the fourth embodiment of the present invention, in which the adhesive agent 107 is coated between the sealing material 106 and the second sealing material 108 is coated on the circumference of the sealing material 106.

[Fifth Embodiment]

Figure 13A:
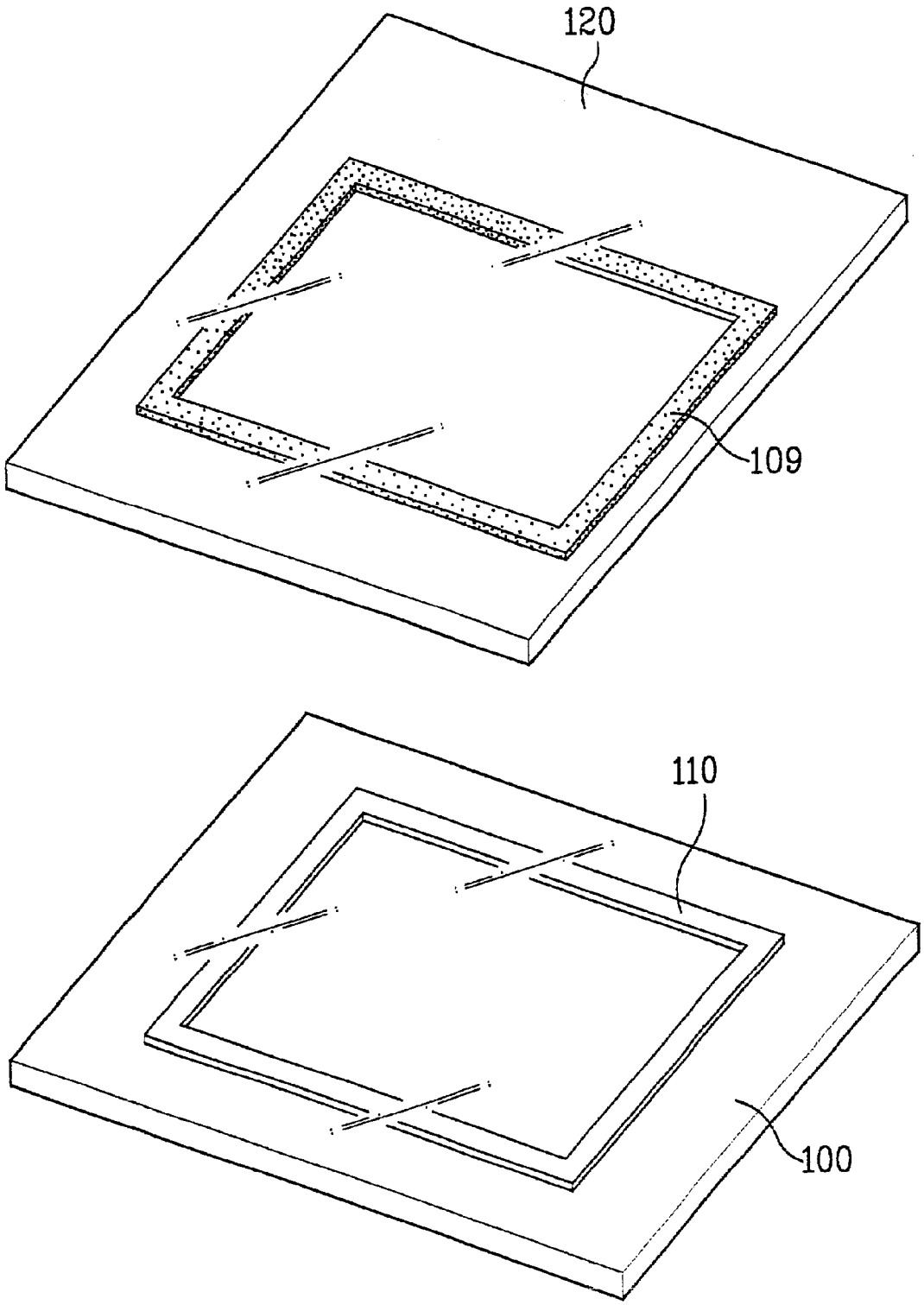
FIG. 13A to FIG. 13C illustrate a PDP combination process according to a first embodiment of the present invention.

In a fifth embodiment of the PDP combination process according to the present invention, as shown in FIG. 13A, an elastomer based sealing material 109 is coated on a circumference of an effective image area of the upper plate 100 to surround. And, a frit 110 is coated on an area of the lower plate 120 corresponding to the area coated with the sealing material 109. Then, a plasticizing process is carried out thereon.

In this case, the elastomer based sealing material 109, despite having no adhesiveness, is a rubber producing no impurity gas in accordance with heating or pressurization and has its own elasticity enough to reduce the external impact.

Figure 13B:
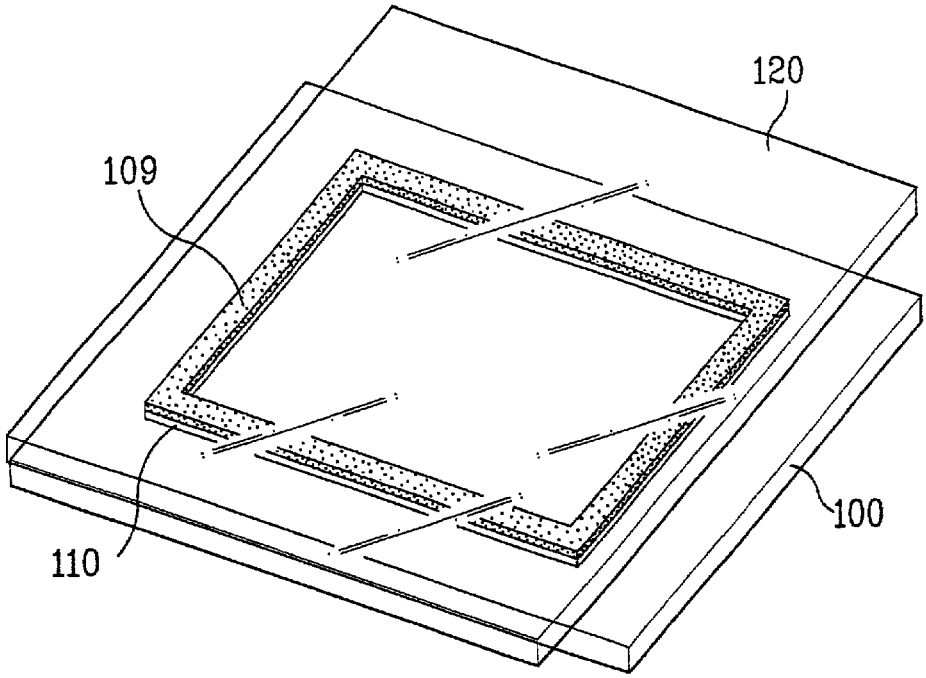

Referring to FIG. 13B, the lower plate 120 is aligned to the upper plate 100.

Figure 13C:
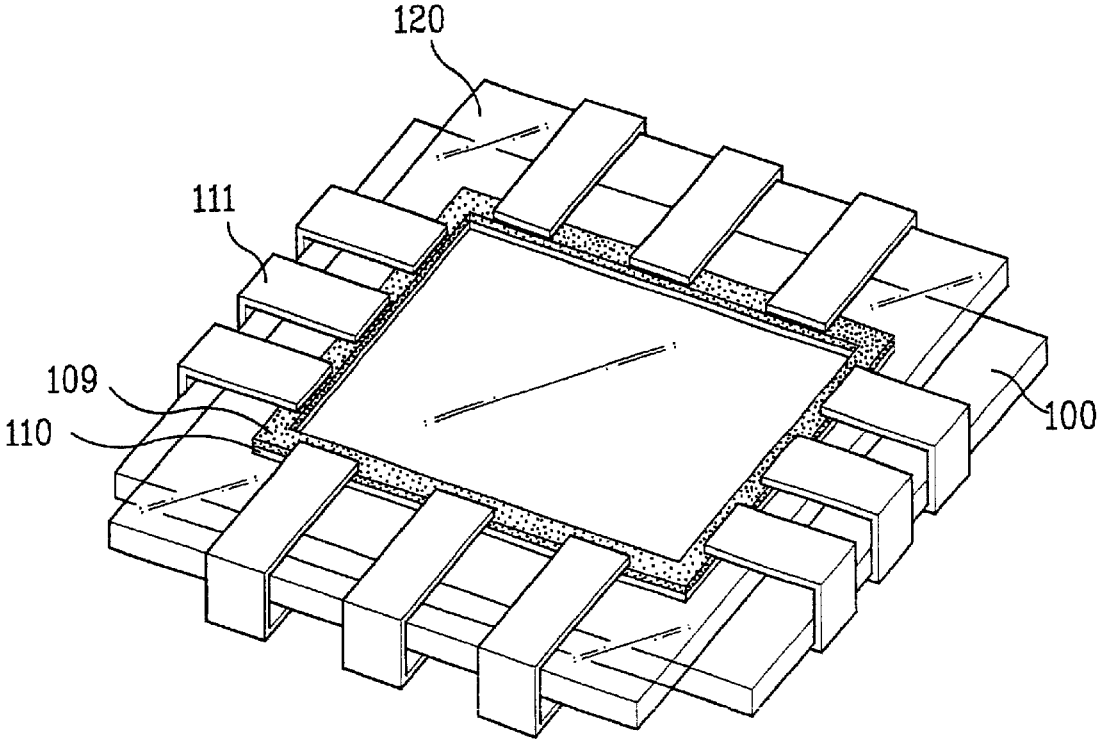

Referring to FIG. 13C, the upper and lower plates 100 and 120 are combined and attached each other using at least a pressurizing means such as a clip 111.

In this case, the clip 111 having a restoring force toward a direction of fastening the upper and lower plates 100 and 102 applies a predetermined pressure to the upper and lower plates 100 and 120 so as to seal up the upper and lower plates 100 and 102 by the sealing material 109.

Moreover, the sealing material 109 having elasticity buffs the force of the clip 111 fastening the upper and lower plates 100 and 120 as well as the external impact.

The above-described combination processes according to the first to fifth embodiment of the present invention are carried out at a room temperature, thereby requiring no cooling and heating processes after combining the upper and lower plates by melting the frit. Therefore, the present invention enables to prevent energy loss as well as reduce a process time.

Using the elastomer based sealing material enabling a room-temperature combination/attachment produces no impurity gas, the present invention enables to produce a real product having no exhaust pipe, i.e. tip-less, by preventing the fatal discharge gas contamination of the 'tip-less'. Nevertheless, using an exhaust pipe, the present invention enables to decrease the exhaust time by reducing the impurity gas content in the combined panel so as to be applied to the real product fabrication.

Specifically, the present invention enables to overcome the discharge gas contamination fatal to the 'tip-less', thereby more preferable to be applied to the 'tip-less' system having such advantages as process equipment simplification, process time reduction and the like. instead of the system using an exhaust pipe.

Discharge gas is injected inside the panel in the system using an exhaust pipe after the combination/attachment, while the other combination/attachment is carried out in a chamber filled up with discharge gas in the 'tip-less' system. In both cases, the pressure inside the panel becomes about 500 Torr, which is lower than the atmospheric pressure. Therefore, the adhesiveness/combination force between the upper and lower plates 100 and 120 is more increased by both of the atmospheric pressure to which the upper and lower plates are exposed to after the fabrication and the combination processes according to the first to fifth embodiments of the present invention.

Accordingly, a PDP fabrication process according to the present invention has the following advantages and effectiveness.

First, the major processes are carried out in the equipments in one body which is isolated from external environment and maintains a vacuum state therein so as to block the generation or entrance of impurities. Thus, the MgO passivation layer of the upper plate is not exposed to the atmosphere so as to prevent the generation of impurity gas as well as minimize the time for exhausting the impurity gas. Therefore, the total fabrication process time is reduced to increase the product yield and the space for equipments is reduced.

Second, the upper plate having the MgO passivation layer thereon is transferred to a next stage without being exposed to the atmosphere, thereby preventing the degradation of the panel characteristic due to the passivation contamination generated from the reaction between the MgO passivation layer and atmosphere.

Third, impurities remaining in the panel are removed using a cleaning chamber, thereby preventing the degradation of the panel characteristic due to the remaining impurities after the fabrication of the panel.

Fourth, the combination/attachment process is carried out at a room temperature, thereby enabling to prevent the degradation of the panel characteristic by the fewer burdens applied to the panel unlike the conventional high pressure/temperature condition.

Fifth, the combination/attachment process is carried out at a room temperature, thereby enabling to minimize energy loss.

Sixth, the combination/attachment process is carried out while maintaining the same state as discharge gas is injected, thereby enabling to prevent a panel damage caused by the breakage of an exhaust pipe unnecessary for the discharge gas injection.

Seventh, the combination/attachment process is carried out at a room temperature, thereby enabling to prevent the degradation of the panel characteristic by the fewer burdens applied to the panel unlike the conventional high pressure/temperature condition.

Eighth, the combination/attachment process is carried out at a room temperature, thereby enabling to minimize energy loss without the heating/cooling process required for the combination process using the conventional frit.

Ninth, an elastomer based rubber instead of a glass based sealing material is used as a sealing material so as to be from impurity gas exhaustion, thereby enabling to prevent the degradation of the panel characteristic due to the discharge gas contamination.

Tenth, an elastomer based rubber instead of a glass based sealing material is used as a sealing material, thereby enabling to prevent the panel damage, which is caused by an external shock, by elasticity of the sealing material.

The forgoing embodiments are merely exemplary and are not to be construed as limiting the present invention. The present teachings can be readily applied to other types of apparatuses. The description of the present invention is intended to be illustrative, and not to limit the scope of the claims. Many alternatives, modifications, and variations will be apparent to those skilled in the art.

What is claimed is:

1. An apparatus for fabricating a plasma display panel comprising:

a passivation layer formation means for forming a MgO passivation layer on a first substrate;

a substrate transfer means for receiving the first substrate from the passivation layer formation means, the substrate transfer means transferring the received first substrate and a second substrate inserted therein to a next fabrication stage;

a cleaning means for removing impurities existing on the first or second substrate transferred through the substrate transfer means;

a sealing material coating means for coating a sealing material on the first substrate transferred through the cleaning means; and a discharge gas injection/combination means for injecting discharge gas inside, the discharge gas injection/combination means for aligning precisely the first substrate transferred through the sealing material coating means and the second substrate with each other using an alignment robot, the discharge gas injection/combination means for combining the first and second substrates with each other.

2. The apparatus of claim 1, wherein the first and second substrates are upper and lower plates, respectively.

3. The apparatus of claim 1, wherein a vision system is applied to the alignment robot.

4. The apparatus of claim 1, further comprising a pre-alignment means for temporarily aligning the first and second substrates transferred through the substrate transfer means.

5. The apparatus of claim 1, further comprising a discharge gas refinement means for recovering discharge gas remaining in the discharge gas injection/combination means after completing the combination, refining the recovered discharge gas by removing impurities therein, extracting a portion of the discharge gas satisfying a predetermined quality, and storing the extracted portion of the discharge gas therein.

6. The apparatus of claim 1, wherein the passivation layer formation means, substrate transfer means, cleaning means, sealing material coating means, and discharge gas injection/combination means are built in one body to be isolated from outside so as to carry out a process until the combination is achieved in a state that the first substrate having the MgO passivation layer and the second substrate are not exposed to the atmosphere.

7. The apparatus of claim 1, further comprising a panel unloading means for drawing out the panel combined in the discharge gas injection/combination means so as to load the panel outside.

8. The apparatus of claim 7, further comprising a panel loading means for loading the panel withdrawn from the panel unloading means.

9. In an apparatus including a first to a fourth chamber which are built in one body isolated from the atmosphere wherein processes of passivation layer formation, exhaust, discharge gas injection, and combination are carried out in the apparatus, a process for fabricating a plasma display panel comprising:

a passivation layer formation step of forming a MgO passivation layer on a first substrate in the first chamber;

a cleaning step of transferring the first substrate having the MgO passivation layer and a second substrate to the second chamber without being exposed to the atmosphere and carrying out vacuum exhaust or cleaning in the second chamber;

a sealing material coating step of transferring the cleaned first and second substrates to the third chamber and coating the first substrate with a sealing material; and a combination step of transferring the sealing material coated first substrate and the second substrate to the fourth chamber, aligning the first and second substrates with each other while discharge gas is injected in the fourth chamber, and combining/attaching the first and second substrates with/to each other.

10. The process of claim 9, wherein the first and second substrates are upper and lower plates, respectively.

11. The process of claim 9, further comprising a discharge gas refinement step of recovering the remaining discharge gas after completing the combination step in the fourth chamber, refining the recovered discharge gas by removing impurities therein, and extracting a portion of the discharge gas.

12. The process of claim 9, wherein the sealing material coating step and the combination step are carried out at a room temperature.

13. The process of claim 12, wherein the room temperature is 50° C.

14. In a process for fabricating a plasma display panel using an ultraviolet ray producing means, the process comprising the steps of:

coating a predetermined area of a first substrate with a sealing material having elasticity and hardened by ultraviolet rays;

aligning a second substrate with the first substrate; and combining/attaching the first and second substrates with/to each other by applying the ultraviolet rays to the sealing material with the ultraviolet ray producing means.

15. The process of claim 14, wherein the sealing material is an elastomer based material.

16. A process for fabricating a plasma display panel including the steps of:

coating a predetermined area of a first substrate with a sealing material having elasticity;

aligning a second substrate with the first substrate; and combining/attaching the first and second substrates with/to each other using at least two pressurization means for applying a predetermined pressure to circumferences of the aligned first and second substrates to seal up.

17. The process of claim 16, wherein the pressurization means are mounted thereon so as to confront each other with a constant interval therebetween.

18. The process of claim 16, wherein all the steps are carried out at the normal temperature.

19. The process of claim 16, wherein all the steps are carried out at the normal temperature.

20. A process for fabricating a plasma display panel including the steps of:

coating a predetermined area of a first substrate with a sealing material having elasticity;

coating a circumference of the sealing material coated area of the first substrate with an adhesive agent; aligning a second substrate with the first substrate; and combining/attaching the first and second substrates with/to each other by maintaining for a while a state that a pressure is applied to the first and second substrates until the adhesive agent coagulates.

21. The process of claim 20, wherein the sealing material is an elastomer based material.

22. A process for fabricating a plasma display panel including the steps of:

coating a predetermined area of a first substrate with a first sealing material and another predetermined area of a second substrate corresponding to the first-sealing material-coated area of the first substrate with a second sealing material;

coating an upper surface of the first or second sealing material with an adhesive agent;

aligning the first and second substrates with each other;

combining/attaching the first and second substrates with/to each other by maintaining for a while a state that a pressure is applied to the first and second substrates until the adhesive agent coagulates; and sealing an area including a first interface between the first and second sealing materials and a second interface between the first and second sealing materials and the first and second substrates with a third sealing material.

23. The process of claim 22, wherein the first and second sealing materials are made of the same material.

24. The process of claim 22, wherein the first and second sealing materials are made of an elastomer based material.

25. The process of claim 22, wherein the adhesive agent coagulates at a normal temperature and has elasticity.

26. The process of claim 22, wherein the third sealing material is one of a silicon based material and a polymer based material.

27. A process for fabricating a plasma display panel including the steps of:

coating a predetermined area of a first substrate with a first sealing material;

coating a predetermined area of a second substrate corresponding to the first-sealing material-coated area of the first substrate with a second sealing material and carrying out a firing process thereon;

aligning the first and second substrates with each other; and combining/attaching the first and second substrates with/to each other by installing circumferences of the first and second substrates with at least two pressurization means.

28. The process of claim 27, wherein the sealing material is an elastomer based material.

29. The process of claim 27, wherein the second sealing material is a frit.

30. The process of claim 27, wherein the pressurization means are mounted thereon so as to confront each other with a constant interval therebetween.

31. A plasma display panel comprising:

a first substrate;

a sealing material coated on a predetermined area of an effective image circumference of the first substrate, the sealing material having predetermined width and height;

a second substrate aligned over the first substrate, the second substrate adhering closely to a surface of the sealing material; and a plurality of pressurization means for applying a predetermined pressure so as to maintain a combination/attachment state between the first and second substrates, the pressurization means mounted along the circumference of the first substrate and a circumference of the second substrate with a predetermined interval therebetween.

32. The plasma display panel of claim 31, wherein the sealing material is an elastomer based material.

33. The plasma display panel of claim 31, wherein a plurality of the pressurization means are mounted so that each pair of the pressurization means confronts each other.

34. A plasma display panel comprising:

a first substrate;

a sealing material coated on a predetermined area of an effective image circumference of the first substrate, the sealing material having predetermined width and height;

an adhesive agent coated on a circumference of the sealing material; and a second substrate aligned over the first substrate, the second substrate adhering closely to a surface of the sealing material.

35. The plasma display panel of claim 34, wherein the sealing material is an elastomer based material.

36. A plasma display panel including:

a first substrate wherein a first sealing material having predetermined width and height is coated on a predetermined area of an effective image circumference of the first substrate and wherein an adhesive agent is coated on the first sealing material;

a second substrate aligned over the first substrate wherein a second sealing material having a predetermined width and height is coated on an area of the second substrate confronting the first sealing material; and a third sealing material sealing an area including a first interface between the first and second sealing materials and a second interface between the first and second sealing materials and the first and second substrates with.

37. The plasma display panel of claim 36, wherein the first and second sealing materials are made of an elastomer based material.

38. The plasma display panel of claim 36, wherein the third sealing material is one of a silicon based material and a polymer based material.

39. A plasma display panel including:

a first substrate wherein a first sealing material having predetermined width and height is coated on a predetermined area of an effective image circumference of the first substrate;

a second substrate aligned over the first substrate wherein a second sealing material having a predetermined width and height is coated on an area of the second substrate confronting the first sealing material; and a plurality of pressurization means for applying a predetermined pressure so as to maintain a combination/attachment state between the first and second substrates, the pressurization means mounted along circumferences of the first and second substrates with a predetermined interval therebetween.

40. The plasma display panel of claim 39, wherein the first sealing material is an elastomer based material.

41. The plasma display panel of claim 39, wherein the first sealing material is a frit.

42. The plasma display panel of claim 39, wherein a plurality of the pressurization means are mounted so that each pair of the pressurization means confronts each other.

* * * * *